US005154064A

United States Patent [19]

Franklin

[11] Patent Number: 5,154,064

[45] Date of Patent: Oct. 13, 1992

[54] FOOD FREEZING AND COOL WATER AND SLUSH ICE PRODUCER

[76] Inventor: Paul R. Franklin, P.O. Box 37978, Jacksonville, Fla. 32236-7978

[21] Appl. No.: 791,210

[22] Filed: Nov. 13, 1991

[51] Int. Cl.[5] ..... F25D 3/00

[52] U.S. Cl. ..... 62/59; 62/121; 62/307; 62/388; 62/434

[58] Field of Search ..... 62/59, 121, 306, 307, 62/384, 388, 430, 434

[56] References Cited

U.S. PATENT DOCUMENTS

| | | | |
|---|---|---|---|
| 1,712,701 | 5/1929 | Hassensall | 62/306 |
| 2,893,216 | 7/1959 | Seefeldt et al. | 62/384 X |
| 3,400,551 | 9/1968 | Booth et al. | 62/306 X |
| 4,094,164 | 6/1978 | Cope | 62/121 X |
| 4,680,119 | 7/1987 | Franklin Jr. | 261/93 X |
| 4,838,039 | 10/1989 | Knodel | 62/434 X |
| 4,848,095 | 7/1989 | Franklin | 62/121 |
| 5,092,133 | 3/1922 | Franklin | 62/59 |

*Primary Examiner*—William E. Tapolcal

*Attorney, Agent, or Firm*—Jacobson, Price, Holman & Stern

[57] ABSTRACT

An open top tank is provided in which slush ice may be rapidly formed by a method forcibly projecting the formed slush ice from the tank or by a method retaining the slush ice within the tank for removal therefrom by other means. In addition, the tank may be used to cool liquid therein such as proplylene glycol down to −20° F.−30° F. degrees such that food stuffs may be dipped into the chilled propylene glycol for quick freezing of the food. The tank is portable and needs only a supply of liquid $CO_2$ under pressure and propylene glycol (or water if slush ice is to be formed).

7 Claims, 1 Drawing Sheet

FOOD FREEZING AND COOL WATER AND SLUSH ICE PRODUCER

BACKGROUND OF THE INVENTION

1. Field of the Invention

This invention relates to an apparatus in which propylene glycol may be chilled through the utilization of liquid $CO_2$ to a temperature considerably below freezing to thereby enable food to be immersed in the propylene glycol for quick freezing the food.

In addition, the same apparatus may be utilized to cool water and to form and to project, over a considerable distance, slush ice.

2. Description of Related Art

Various different forms of devices utilizing some of the general structural and operational features of the instant invention heretofore have been provided such as those disclosed in U.S. Pat. No. 4,848,095 and my co-pending U.S. application Ser. No. 07/638,816, now U.S. Pat. No. 5,092,133. However, these previously known devices do not include the capability of chilling propylene glycol to a temperature considerably below freezing and in a manner such that baskets containing food to be quick frozen may be immersed, for a short period of time, in the cooled propylene glycol. Further, these previously known devices also fail to include structure by which slush ice may be formed and projected from the apparatus over considerable distances.

SUMMARY OF THE INVENTION

The food freezing and cool water and slush ice producer of the instant invention incorporates an open top tank which may contain propylene glycol and in which propylene glycol may be cooled to a temperature considerably below freezing for the purpose of immersing food to be quick frozen within the chilled propylene glycol. Also, the tank may be utilized to contain water and to have water supplied thereto at a considerable volume rate and have the water transformed into slush ice and forcibly propelled from the tank over appreciable distances to thereby enable the apparatus to be used to project slush ice into a remote food container or truck body and the like.

The main object of this invention is to provide an apparatus in which food may be quick frozen and which also may be used to produce slush ice at a considerable rate and at minimal cost.

Another object of this invention is to provide an apparatus which may be readily transported from on location to another.

Still another important object of this invention is to provide an apparatus which may be used in the field to produce slush ice for initial packing of farm products in ice as they are picked.

Another object of this invention is to provide a slush ice producer which will be capable of producing slush ice, at least intermittently, at a relatively high rate.

Yet another object of this invention is to provide a slush ice producer which may be transported to substantially any location having a supply of water and utilized to produce slush ice substantially immediately upon demand.

A final object of this invention to be specifically enumerated herein is to provide an apparatus in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
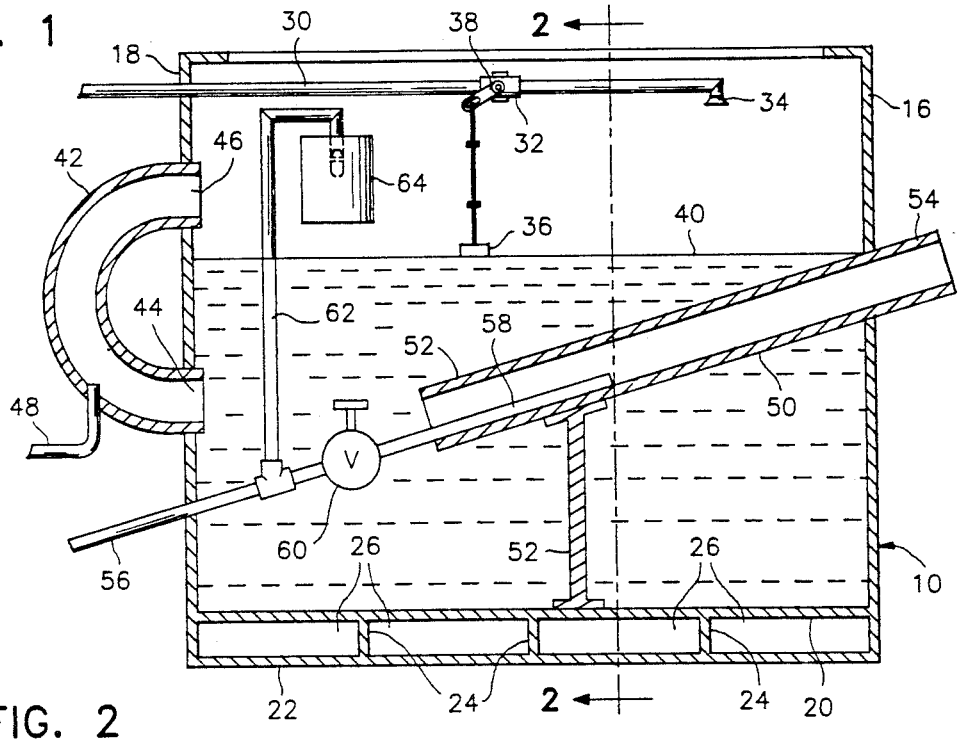
FIG. 1 is a vertical sectional view of a food freezing and cool water and slush ice producer constructed in accordance with the present invention.
Figure 2:
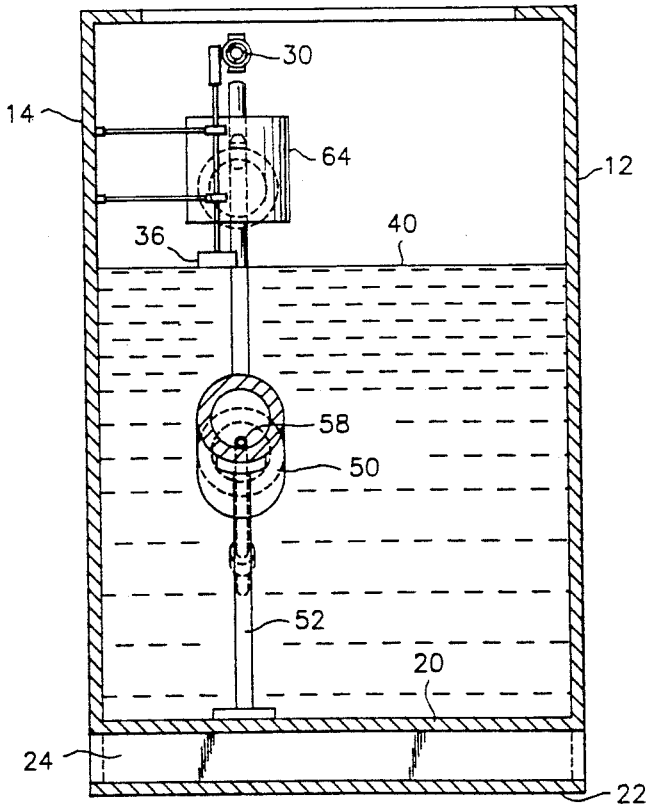
FIG. 2 is a transverse sectional view taken substantially upon the plane indicated by the section line 2—2 of FIG. 1.

Referring now more specifically to the drawings the numeral 10 generally designates an open top tank including opposite sides 12 and 14, opposite ends 16 and 18 and a bottom wall 20. In addition, a lower wall 22 is disposed below the bottom wall and is braced relative thereto by the side and end walls as well as partition walls 24 in order to form horizontal compartments 26 in which to receive the forks of a forklift truck for transport of the tank 10 from one location to another. It is also to be noted that the bottom and lower walls 20 and 22 extend between and interconnect the lower marginal portions of the opposite side and end walls 12, 14 and 16, 18.

The end wall 18 receives an intermediate length portion of a water supply pipe 30 therethrough including a float valve 32 serially connected therein and an outlet fixture 34 at its outlet end, a float 36 being guidingly supported from the rear side wall 14 and operatively connected to the operator arm 38 of the float valve 32. Of course, the float valve 32 is operative to control the flow of water into the tank 10 through the pipe 30 in order to maintain the water at the level 40 illustrated in FIG. 1.

The tank 10 also includes a circulation pipe 42 including an inlet end 44 which opens inwardly through the end wall 18 below the level 36 and an outlet end 44 which opens through the end wall 18 above the level 40, substantially entire length of the circulation pipe 4 being disposed exteriorly of the tank 10 in order to reduce the possibility of excessive ice being formed within the circulation pipe 42 and clogging the passage of water and slush ice therethrough.

A liquid $CO_2$ supply line 48 opens upwardly in the lower portion of the circulation pipe 42 and includes two $\frac{1}{8}$ inch orifices at the discharge end thereof for discharging liquid $CO_2$ upwardly into the circulation pipe 4 with sufficient force to cause water from the interior of the tank 16 to enter the inlet end 44, pass rapidly upwardly through the circulation pipe 42 and be discharged back into the interior of the tank 10 from the discharge end 46 of the pipe 42. Of course, as the water within the tank 10 is drawn into and propelled through the circulation pipe 42 it is quickly reduced in temperature (by approximately 40 to 50 degrees F.).

Also, a combined eductor and discharge pipe 50 is mounted within the tank 10 by a brace 52 supported from the bottom wall 20 and the pipe 50 includes a lower inlet end 52 adjacent the end wall 18 and an outlet end 54 which projects through the end wall 16 in sealed relation therewith at a level generally corresponding to the level 40.

A second $CO_2$ supply line 56 is provided and opens inwardly into the interior of the tank 10 through the end wall 18 thereof. The supply line 56 includes an outlet end 58 projecting into the inlet end of the pipe 50 and the outlet end 58 includes suitable discharge orifice means such as a single one ⅛ inch diameter orifices.

The supply line 56 has a manual control valve 60 serially connected therein and also incorporates a branch line 62 which opens outwardly of the line 56 upstream from the valve 60 and extends upward in the tank to a point spaced above the level 40 and has a downwardly directed $CO_2$ snow forming nozzle 64 mounted thereon.

The upstream ends of the supply lines 48 and 56 are provided with control valves (not shown) and upstream from the control valves the lines 48 and 56 are communicated with the same source of liquid $CO_2$ under pressure.

In order to form slush ice and to project slush ice a considerable distance from the tank 10, the supply line 48 is not used and liquid $CO_2$ under pressure is supplied to the supply line 56. Liquid $CO_2$ is discharged downwardly from the nozzle 64 on top of the water within the tank 10 and liquid $CO_2$ is discharged from the discharge orifice at the outlet end 58 of the supply line 56 within the pipe 50. The $CO_2$ snow discharged onto the surface of the water 40 appreciably chills the water and the discharge of liquid $CO_2$ from the outlet end 58 of the supply line 56 within the pipe 50 causes water from within the tank 10 to be educted into the inlet end 52 of the pipe 50 and to be forcibly discharged from the latter at high speed through the outlet end thereof. Meanwhile, as the chilled water enters the inlet end 52 of the pipe 50 and is thereafter subject to the discharge of the liquid $CO_2$ from the outlet end 58 of the supply line 56, the transformation of substantially all of the water passing upward through the pipe 50 into slush ice is completed and it has been found that once in operation the apparatus illustrated in FIG. 1 may propel slush ice from the outlet end 54 of the pipe 50 to distances up to 60 feet from the tank 10. Of course, as water is discharged from the tank 10 through the pipe 50, it is replaced by water entering the tank 10 through the pipe 30 and valve 32 as well as the outlet fitting 34, the float 36 serving to maintain the level of water within the tank 10 as illustrated at 40 in FIG. 1.

However, if it is desired not to expel the slush ice formed within the tank 10 at a rapid rate from the discharge end 54 of the pipe 50, the valve 60 may be closed and liquid $CO_2$ may be discharged into the circulation pipe 42 from the supply line 48. In this manner, slush ice may be rapidly formed within the tank 10 and conveyed outward therefrom by other suitable means (not shown).

It may thus be seen that the tank 10 may be utilized to maintain propylene glycol therewithin at a temperature of between −40 and −30 degrees F. in order that bags of food stuffs may be dipped into the propylene glycol liquid within the tank 10 for fast freezing thereof. Also, the tank 10 may be used to form slush ice which may either be rapidly projected therefrom through the outlet end 54 of the pipe 50 or removed by other means (not shown) from the tank 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A liquid cooler including a tank to be filled to a predetermined level with a liquid to be cooled, $CO_2$ snow forming means in an upper portion of said tank operative to form $CO_2$ snow within the tank above the level of liquid for falling of the liquid $CO_2$ snow by gravity down onto the surface of said liquid, liquid $CO_2$ injection means operatively associated with said tank and the liquid therein operative to inject liquid $CO_2$ under pressure into said liquid for additional rapid cooling of said liquid, said liquid $CO_2$ injection means including a pipe having an inlet end portion opening into said tank below said level and a downstream outlet end portion projecting outwardly through one side wall of said tank, said $CO_2$ injection means also including a liquid $CO_2$ injection supply line opening into said inlet end portion and along said pipe toward said downstream outlet end portion, said downstream outlet end portion extending upwardly from said inlet end portion.

2. The slush ice producer of claim 1 wherein said downstream outlet end portion is operative to discharge said liquid from said tank under pressure applied thereto by the injection of liquid $CO_2$ discharged into said pipe in a downstream direction.

3. The slush ice producer of claim 1, wherein said downstream outlet end portion opens outwardly of said tank at a level generally corresponding to the first mentioned level.

4. The slush ice producer of claim 2 wherein said liquid comprises propylene glycol into which food to be quick frozen may be dipped.

5. The method of forming slush ice and projecting the formed slush ice to a closely remote use area, said method comprising providing a tank with a water inlet supply therefore operative to maintain water in said tank to a predetermined level, providing a generally straight, large diameter tube having an inlet end disposed in said tank, an intermediate length portion extending through one upstanding wall of said tank and an outlet end disposed exteriorly of said upstanding wall with said inlet end disposed below said level and said outlet end elevated relative to said inlet end and disposed at least at said level, discharging $CO_2$ snow downwardly in said tank onto the surface of the water therein, and injecting liquid $CO_2$ under pressure into the inlet end of said tube in a downstream direction toward the tube outlet end with sufficient velocity and volume in relation to the inside cross section of said pipe to propel cooled water and slush ice through said tube and out said outlet end with sufficient force to project the water and slush ice at least three meters outwardly from the tank.

6. A liquid cooler including a tank to be filled to a predetermined level with a liquid to be cooled, liquid $CO_2$ injection means operatively associated with said tank and liquid therein operative to inject liquid $CO_2$ under pressure into said liquid for rapid cooling of said liquid, said liquid $CO_2$ injection means including a pipe having an inlet end portion opening into said tank below said level and a downstream outlet end portion projecting outwardly of said tank, said $CO_2$ injection means including a liquid $CO_2$ injection supply line opening into said inlet portion and along said pipe toward said downstream outlet end portion extending upwardly at least to a level generally corresponding to the first mentioned level.

7. The method of forming slush ice and projecting the formed slush ice to a closely remote use area, said method comprising providing a tank having a supply of water therein and adapted to have the water in said tank maintained to a predetermined level, providing a generally straight, large diameter tube having an inlet end disposed in said tank below said level and an outlet end opening outwardly exteriorly of said tank and elevated relative to said inlet end at least to said level, injecting liquid $CO_2$ under pressure into the inlet end of said tube in a downstream direction toward the tube outlet end with sufficient velocity and volume in relation to the inside cross section of said pipe to propel water and slush ice through said tube and outwardly of said outlet end with sufficient force to propel the water and slush ice at least three meters outwardly from the tank.

* * * * *